United States Patent [19]

Armelin

[11] Patent Number: 4,863,086

[45] Date of Patent: Sep. 5, 1989

[54] DEVICE FOR SUPPLYING A MACHINE WORKING ON A WEB OF MATERIAL IN STOPPED POSITION, MORE PARTICULARLY BUT NOT EXCLUSIVELY APPLICABLE TO SUPPLYING A FLAT CUTTING PRESS

[75] Inventor: Michael Armelin, London, England

[73] Assignee: Machines Chambon S.A., Orleans, France

[21] Appl. No.: 221,081

[22] Filed: Jul. 19, 1988

[30] Foreign Application Priority Data

Jul. 30, 1987 [FR] France ..... 87 10817

[51] Int. Cl.[4] ..... B65H 23/16; B65H 23/18

[52] U.S. Cl. ..... 226/152; 226/114

[58] Field of Search ..... 226/113, 114, 152, 118, 226/119, 154, 155, 8

[56] References Cited

U.S. PATENT DOCUMENTS

| | | | |
|---|---|---|---|
| 3,515,327 | 6/1970 | Bortmas | 226/113 |
| 3,727,820 | 4/1973 | Braun | 226/113 |
| 3,926,355 | 12/1975 | Bonnell | 226/114 |
| 4,014,491 | 3/1977 | Gref et al. | 226/113 |
| 4,060,187 | 11/1977 | Grob | 226/8 |
| 4,071,178 | 1/1978 | Copp | 226/114 X |
| 4,244,504 | 1/1981 | Grob et al. | 226/114 |
| 4,609,336 | 9/1986 | Stevenson et al. | 226/113 X |
| 4,798,353 | 1/1989 | Peugh | 226/114 X |

*Primary Examiner*—Stuart S. Levy
*Assistant Examiner*—Phillip S. Han
*Attorney, Agent, or Firm*—McAulay Fisher Nissen & Goldberg

[57] ABSTRACT

A device for supplying a machine working on a web of material in a stopped position particularly for a flat cutting press and in the vicinity of an intake roller and downstream thereof, in the direction of advance of the web, the device includes an oscillating roller. This roller is mounted for rotation on a support adapted to oscillate about the axis of the intake roller. The oscillating roller is driven in rotation on itself from the intake roller, via a transmission mechanism in such a manner that the peripheral speed of the oscillating roller is identical to that of the web of material winding around part of the periphery of this oscillating roller. A mechanism is provided for provoking a movement of oscillation of the support and of the roller that is bears. Other means mechanism is provided for maintaining the tension of the web disposed at the entrance of the machine and for cyclically controlling the movement of oscillation of the support and of the oscillating roller that it bears so that the length of the part of the web between the intake roller and the machine is lengthened or shortened to provide the desired law for the advance of the web in the machine and a law which includes in particular a stop phase in the machine.

17 Claims, 3 Drawing Sheets

1
2
3
4
5
6
7
8
9
14
15
16
17
18
19
25
27
28
29
31
32
33,34
35
36
37
38
39
41
C
v
vt
II

DEVICE FOR SUPPLYING A MACHINE WORKING ON A WEB OF MATERIAL IN STOPPED POSITION, MORE PARTICULARLY BUT NOT EXCLUSIVELY APPLICABLE TO SUPPLYING A FLAT CUTTING PRESS

BACKGROUND OF THE INVENTION

The present invention relates to a device for supplying a machine working on a web of material in a stopped position. More particularly but not exclusively, the invention is concerned with supplying a flat cutting press.

In a flat cutting press which ensures a cyclic cut-out of a continuous web printed or not, of a material such as cardboard, this web is generally delivered upstream, in continuous manner, from a reel. As the flat cutting press is a machine which necessitates a momentary stop of the advance of the web of material, during the cutting operation, an accumulation is produced of the material to be cut, upstream of the cutting press, due to the continuous supply. In order to be able to accumulate the length of web supplied upstream, whilst a downstream part of this web is stopped in the flat cutting press, various devices have already been designed for storing the excess length of web in the form of a loop of variable length. This loop lengthens the cutting press is inoperative and it shortens as soon as supply of the cutting press resumes for a subsequent cutting operation, these operations being carried out cyclically. The fact of not holding the web, results in defective positioning of the web as soon as the speed of operation increases.

In order to overcome this drawback, devices avoiding the formation of a free loop, with the aid of a compensating mechanism comprises a mobile roller taking up this loop, have been envisaged. A particular device of this type is described in Patent FR-A-2 408 538 and employs a solution introducing a minimum slide of the web over the roller fast with the compensating mechanism, for a determined cut-out format but this slide becomes considerable if the cut out format varies. Furthermore, such a device requires the machine to stop in order to be adjusted, it comprises a complex mechanism and a double control on each side. As a result, such a device is relatively complex and inconvenient to carry out.

SUMMARY OF THE INVENTION

It is an object of the present invention to overcome these drawbacks by providing a device of particularly simple design, allowing easy adjustment for adaptation thereof to different formats. Such adjustment even being able to be terminated during operation.

To that end, the device for supplying a machine working on a web of material in stopped position particularly for a flat cutting press and with the web being continuously supplied upstream of the machine. The web passes between a pair of intake and counterpart rollers having horizontal and transverse axes, tangential to each other, driven in rotation at a constant peripheral speed. The machine comprises, in the vicinity of the intake roller and downstream thereof, in the direction of advance of the web, an oscillating roller mounted to rotate on a support adapted to oscillate about the axis of the intake roller, this oscillating roller being driven in rotation on itself from the intake roller, via a transmission mechanism, in such a manner that the peripheral speed of the oscillating roller is identical to that of the web of material winding around part of the periphery of this oscillating roller and thus always being in contact with the surface of the oscillating roller for provoking a movement of oscillation of the support and not sliding. Also provided are means of the roller that it bears, means for maintaining the tension of the web disposed at the entrance of the machine and means for cyclically controlling the movement of oscillation of the support and of the oscillating roller that it bears so that the length of the path of the web between the intake roller and the machine, is lengthened or shortened to give the desired law for the advance of the web in the machine and the law including in particular a phase of stop in the machine.

The device acording to the invention offers the advantage that, whatever the format of the operation effected in the machine, for example the cut-out format, there is no slide between the web of material cut out and the oscillating roller since the latter is always driven in rotation at the same peripheral speed as the intake roller, from the latter. This absence of slide avoids altering the printing in the case of a printed web which is in contact with the oscillating roller by its printed face and it makes it possible to maintain the relative positioning of the web in the cutting machine with respect to the other apparatus upstream. Furthermore, the control of the oscillating movement of the oscillating roller is provided on one side only of the device which considerably simplifies matters. Likewise, the supply device comprises means for finely adjusting the amplitude of the movement of oscillation of the oscillating roller, during operation of the device. These means for fine adjustment during operation further make it possible easily to servo-control the device by any magnitude such as the tension of the web.

Another advantage offered by the device according to the invention is that the law of advance of the web comprises a phase of acceleration in which the instantaneous value of the acceleration is controlled in particular so that, when the web starts up, which is a critical phase since detachment of the web from the tool to the machine must be ensured, and such acceleration has a weak value and it then increases progressively.

BRIEF DESCRIPTION OF THE DRAWINGS

The invention will be more readily understood on reading the following description with reference to the accompanying drawings in which.

DESCRIPTION OF THE PREFERRED EMBODIMENTS

Figures 1, 4:
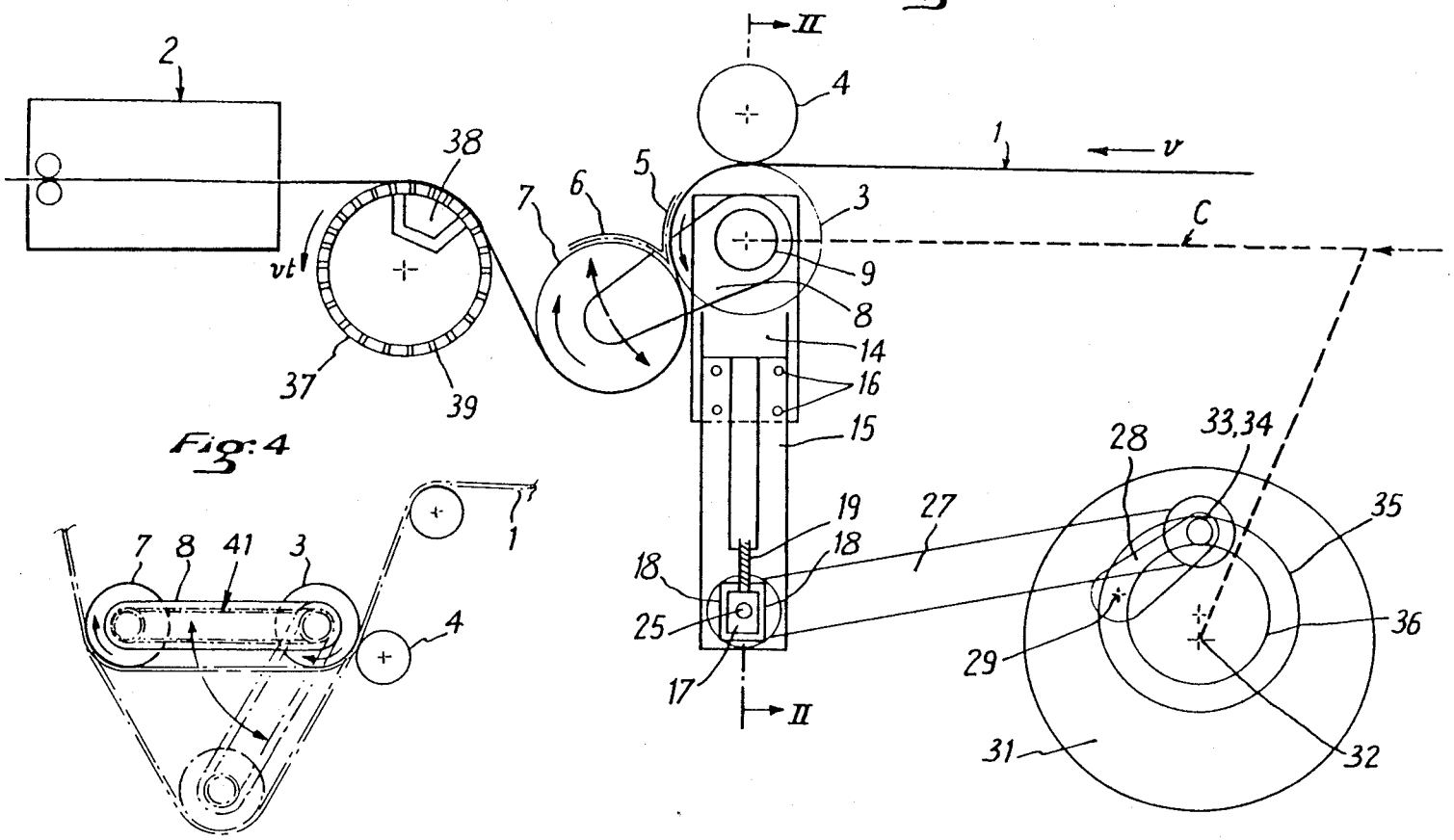
FIG. 1 is a schematic view in elevation of a device according to the invention for supplying a machine working on a web of material in the stopped position.
FIG. 4 is a view in partial elevation of a variant embodiment.

Referring now to the drawings, the device according to the invention ensures inntermittent supply of a web 1 of any material, whether printed or not, which is worked in a stopped position by a machine 2 located downstream, such as for example a flat cutting press.

The web 1 is continuously supplied upstream, at a constant speed v, from any source such as a reel, and it moves from right to left in FIG. 1, in the direction of the forming device 2.

The supply device according to the invention comprises two horizontal and transverse tangential rollers between which the web passes namely a lower intake roller 3 and an upper counterpart roller 4. The intake roller 3, which is located beneath the web, is driven in rotation, from the preceding machine, which is for example a reel, via a mechanical transmission shown schematically in FIG. 1 and generally designated by reference C. The intake roller 3 is fast with a coaxial gearing 5 which meshes with a coaxial gearing 6 fast with an oscillating roller 7 located above the web 1 so that the two rollers 3 and 7 rotate in opposite directions. The ratio of the primitive diameters of these gearings 5,6 corresponds to that of the diameters of the two rollers 3 and 7 so that the latter always rotate at the same peripheral speed.

The oscillating roller 7 is mounted to rotate on a support comprising a pair of parallel arms 8 between the ends of which the oscillating roller 7 extends. The parallel arms 8 are radially fixed to the two ends of a horizontal and transverse hollow shaft, passing coaxially right through the intake roller 3. However, this arrangement is not limiting and the support of the oscillating roller 7 may comprise only one radial arm 8, the oscillating roller 7 in that case being mounted in overhang on this single arm 8. As may be seen in FIG. 2, the intake roller 3 is mounted to rotate on the hollow shaft 9 via roller bearings 11. The hollow shaft 9 is itself mounted to oscillate in uprights of a frame 12, via roller bearings 13.

Figure 2:
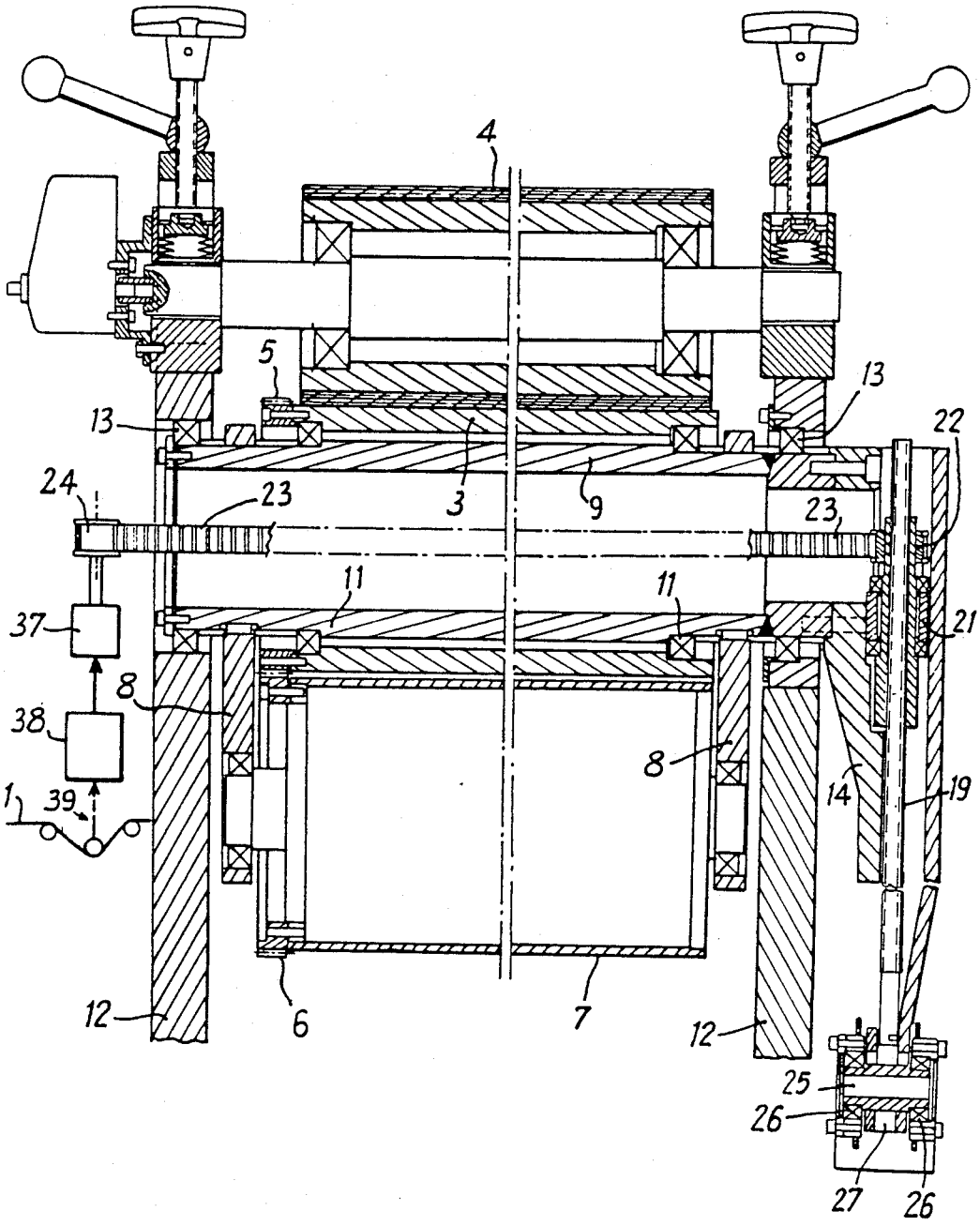
FIG. 2 is a view in vertical and transverse section made along line II-II of FIG. 1, the oscillating roller being assumed to be aligned vertically below the intake roller.
Figure 3:
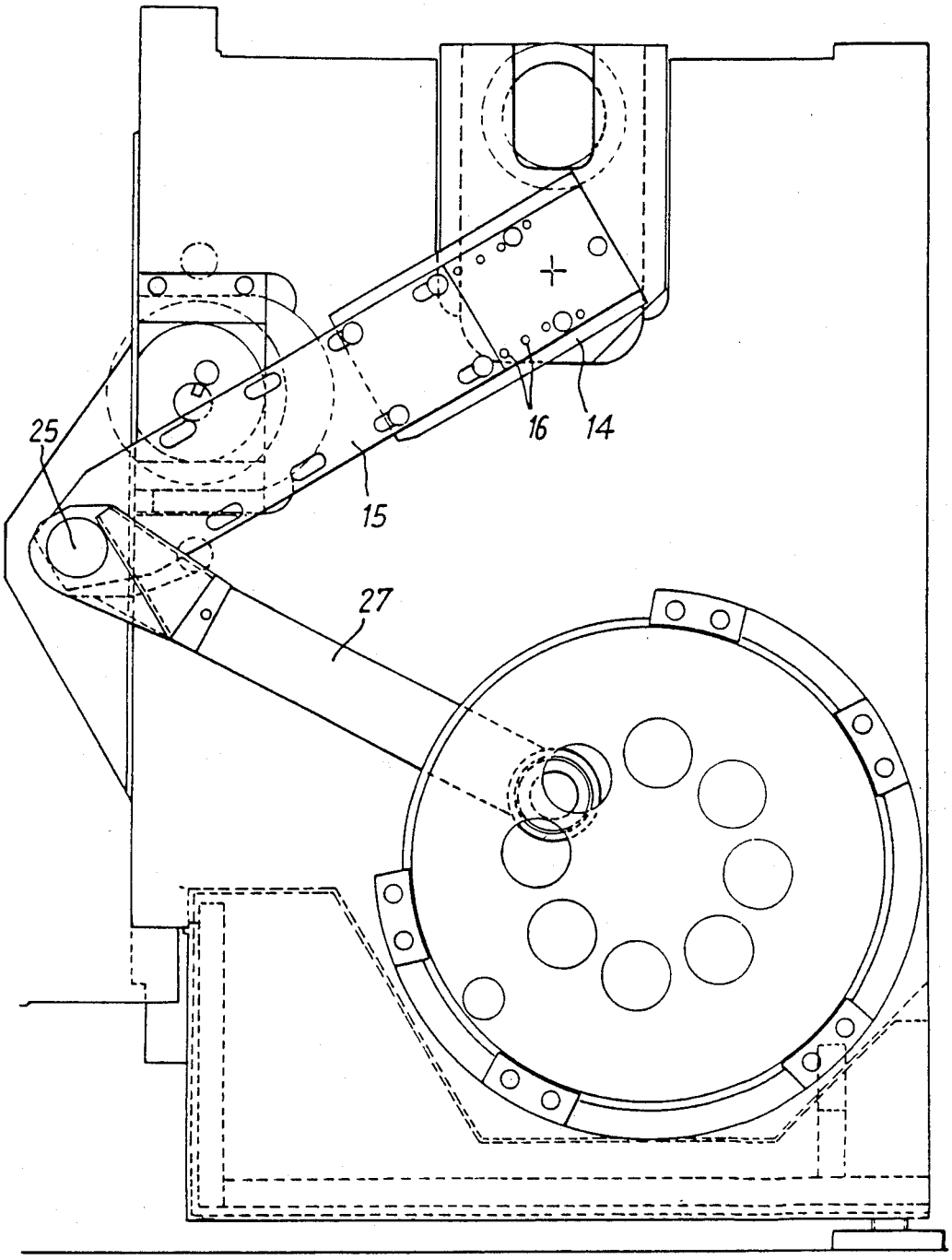
FIG. 3 is a view in partial elevation of the mechanism controlling the movement of the oscillating roller.

The hollow shaft 9 which bears the arms 8 and consequently the oscillating roller 7, is fast, at one of its ends, and in the present case at its right-hand end in FIG. 2, with a radial lever 14 by means of which a movement of oscillation is transmitted to the arms 8. On this lever 14 is fixed, in an adjustable longitudinal position, a radial slide 15 by means of screws 16. At the end of this slide 15 is mounted a sliding block 17 which may be displaced radially on needle runners 18. This sliding block 17 is fast with the lower end of a threaded rod 19 which extends along the slide 15 and the lever 14 and which is in mesh, near the pivot axis of this lever 14, together with a nut 21 itself fast with a coaxial toothed pulley 22 surrounding the upper part of the threaded adjusting rod 19. This toothed pulley 22 is coupled, via a toothed belt 23 extending right through the hollow shaft 9, to another toothed pulley 24 located on the other side of the frame of the device and which may be driven in rotation by an appropriate control mechanism (not shown).

The sliding block 17 is fast with a horizontal and transverse spindle 25 on which is articulated, via roller bearings 26, one end of a connecting rod 27. The other end of the connecting rod 27 is articulated on a crank pin 28 which itself is articulated about a pine 29, on a drum 31 rotating about a horizontal and transverse pin 32. This drum 31 is driven from the general control C of the device. The crank pin 28 bears, at its free end, two cam rollers 33,34 which roll respectively, in two different transverse planes, inside a fixed cam 35 and outside a fixed counter-cam 36, and these two cams have a profile calculated as a function of the desired law of movement.

As may be seen in FIG. 1, the web 1 passes at a constant speed v between the intake roller 3 and the upper counterpart roller 4, and it winds over a part of the peripheral surface of the intake roller 3, and then it passes around half the peripheral surface of the oscillating roller 7, which rotates at the same peripheral speed v as roller 3, due to their coupling by the two gearings 5,6. After being wound beneath the oscillating roller 7, the web rises towards the left and passes over part of the periphery of an aspirating roller or "sliding" roller 37 permanently maintaining tension of the web 1 before entering in the machine 2. This aspirating roller 37 rotates constantly at a peripheral speed $v_t$ greater than that v of the web. Inside the aspirating roller 37 is located a suction box 38 connected to a source of vacuum. This suction box 38 is in contact with part of the inner surface of the roller 37 of which the lateral surface is pierced with holes 39. The position of the suction box 38 and its extension in the direction of rotation of the aspirating roller 37 corresponds to the zone of contact of the web on the peripheral surface of the aspirating roller 37.

When the web 2 is to be stopped for a certain period of time in the forming machine 2, such as a flat cutting press the mechanism for controlling the oscillating roller 7 provokes a displacement of this roller downwardly and towards the right in order to lengthen the path of the web between the intake roller 3 and the aspiring roller 37, since, upstream, the web 1 continues to be supplied at the same speed v. As the peripheral speed of the oscillating roller 7, which is driven in rotation from the intake roller 36, is equal to the peripheral speed of this intake roller 3, i.e. to the actual speed of web 1, there is no slide between the printed upper face of the web 1 and the oscillating roller 7 during this movement of downward pivoting of the arms 8 and of descent of the oscillating roller 7.

Once the operation (for example cutting out) in machine 2 is terminated advance of the web in the machine 2 resumes and, at that moment, the arms 8 and the oscillating roller 7 are slowed down and, as soon as the speed of the web in machine 2 is higher than speed v, they rise again, which shortens the path of the web. Once the web 1 is advanced, in machine 2, by the desired length corresponding to the format, this web is stopped in machine 2, as before, and further to the redescent of the oscillating roller 7, the cycle of lengthening of the path of the web resumes, and so on.

The oscillating roller 7 has a movement of oscillation of which the period corresponds to the cycle of intermittent advance of the web 1 in the forming machine 2. The movement of pivoting of the arms 8 and of the oscillating roller 7 that they bear, about the axis of the intake roller 3, is controlled by the rotation of the drum 31 which is driven in rotation from the general control C. The amplitude of oscillation of arms 8 and of the oscillating roller 7 which is a function of the format, depends on the distance between the pivot pin 25 of the connecting rod 27 on the sliding block 17, and the axis of oscillation, i.e. the axis of the intake roller 3. This distance may be roughly adjusted, when the device is in stopped position, by adjusting the longitudinal position of the slide 15 on the lever 14 and by blocking the slide 15 in the appropriate position, by means of screws 16. Likewise, angular setting of the cams 35,36 is modified. To this rough adjustment may be added a fine adjustment which may be effected whilst the device is operating. Such fine adjustment is effected during operation, by driving in rotation the driving pulley 24 which transmits its movement, via the toothed belt 23, to the other toothed pulley 22 itself fast with the nut 21 screwed on the threaded rod 19. Rotation of the nut 21 is consequently translated by a translation of the rod 19 and of the sliding block 17 that it bears. The toothed belt 23 makes it possible easily to effect this fine adjustment during operation since it may be deformed and follow the movement of oscillation of the arms 8. These means for fine adjustment during operation further make it possible to servo-control the device by any magnitude, such as the tension of the web. To that end, as shown schematically in FIG. 2, the driving pulley 24 may be coupled to the shaft of a servo-motor 37 electrically supplied by a device 38 connected to a sensor 39 for sensing the tension of the web 1, so as to rotate the driving pulley 24 and consequently to modify the adjustment of the amplitude of oscillation as a function of the tension of the web.

In the variant embodiment shown in FIG. 4, the oscillating roller 7 is mounted, on the arms 8, relatively remote from the intake roller 3 which is in that case located above the web 1 like the oscillating roller 7. The two rollers 7 and 3 are coupled via a transmission mechanism 41 ensuring a drive in rotation of the oscillating roller 7 in the same direction and at the same peripheral speed as the intake roller 3. The transmission mechanism 41 may be constituted by a gear train, and an endless toothed belt passing over two toothed wheels respectively fast with the two rollers 3 and 7, etc.

What is claimed is:

1. Device for supplying a machine working on a web of material in stopped position particularly for a flat cutting press, the web being continuously supplied upstream of the machine, passing between a pair of intake and counterpart rollers, of horizontal and transverse axes, tangential to each other, driven in rotation at a constant peripheral speed, comprising:

in the vicinity of the intake roller and downstream thereof, in the direction of advance of the web, an oscillating roller mounted to rotate on a support, which is pivotally mounted about the axis of the intake roller for oscillation said intake roller, said oscillating roller being driven in rotation on itself from the intake roller, via a transmission mechanism, in such a manner that the peripheral speed of the oscillating roller is identical to that of the web of material winding around part of the periphery of this oscillating roller and thus always being in contact with the oscillating roller without sliding on the surface of the oscillating roller;

means for provoking a movement of oscillation of the support and of the roller that it bears; and means for maintaining the tension of the web disposed at the entrance of the machine and means for cyclically controlling the movement of oscillation of the support and of the oscillating roller that it bears so that the length of the path of the web, between the intake roller and the machine, is lengthened or shortened to give the desired law for the advance of the web in the machine, law including in particular a phase of stop in the machine.

2. The device of claim 1, wherein the intake roller, located below the web, is fast with a coaxial gearing which is in mesh, with a coaxial gearing fast with said oscillating roller, located above the web, the ratio of the primitive diameters of the gearings being equal to the ratio of the diameters of the rollers with which they are fast so that the two rollers are driven in rotation in opposite directions, at the same peripheral speed.

3. The device of claim 2, wherein the intake roller, located above the web, is coupled to the oscillating roller, likewise located above the web, via a transmission mechanism ensuring drive in rotation of the oscillation roller in the same direction and at the same peripheral speed as the intake roller.

4. The device of claim 3, wherein the support of the oscillating roller comprises at least one arm fixed to a horizontal and transverse hollow shaft, coaxially passing right through the intake roller, this intake roller is mounted to rotate on the hollow shaft via roller bearings and the hollow shaft is itself mounted to oscillate in uprights of a frame, via roller bearings.

5. The device of claim 4, wherein the hollow shaft is fast, at one of its ends, with a radial level of adjustable length bearing at its end a sliding block articulated on the end of a connecting rod animated by a reciprocating movement.

6. The device of claim 5, including a radial slide fixed in an adjustable longitudinal position on said lever by means of screws; said sliding block being mounted at the end of said radial slide, said slide block being displacable radially and being fast with the lower end of a threaded rod extending along said slide and said lever and which is in mesh near the axis of oscillation of said lever; and a nut itself fast with a coaxial toothed pulley coupled via a toothed belt extending right through said hollow shaft to another driving pulley located on the other side of the frame of said device and which may be driven in rotation.

7. The device of claim 6, wherein the sliding block is fast with a horizontal and transverse spindle on which the end of the connecting rod is articulated via roller bearings.

8. The device of claim 7, wherein the other end of the connecting rod is articulated on a crank pin itself articulated, about a pin, on a drum rotating about a horizontal and transverse pin, the crank pin bearing, at its free end, two cam rollers which roll respectively in two different transverse planes, inside a fixed cam and outside a fixed counter-cam.

9. The device of claim 8, wherein the means for maintaining the tension of the web on entering the machine comprise an aspirating roller rotating constantly at a peripheral speed greater than that of the web and, inside the aspirating roller, a suction box connected to a source of vacuum, this suction box being in contact with a part of the inner surface of the roller of which the lateral surface is pierced with holes, the position of the suction box and its extension in the direction of rotation of the aspirating roller corresponding to the zone of contact of the web on the peripheral surface of the aspirating roller.

10. The device of claim 1, wherein the intake roller, located above the web, is coupled to the oscillating roller, likewise located above the web, via a transmission mechanism ensuring drive in rotation of the oscillation roller in the same direction and at the same peripheral speed as the intake roller.

11. The device of claim 1, wherein the support of the oscillating roller comprises at least one arm fixed to a horizontal and transverse hollow shaft, coaxially passing right through the intake roller, this intake roller is mounted to rotate on the hollow shaft via roller bearings and the hollow shaft is itself mounted to oscillate in uprights of a frame, via roller bearings.

12. The device of claim 11, wherein the hollow shaft is fast, at one of its ends, with a radial lever of adjustable length bearing at its end a sliding block articulated on the end of a connecting rod animated by a reciprocating movement.

13. The device of claim 12, wherein a radial slide is fixed on the lever, in an adjustable longitudinal position, by means of screws, at the end of this slide is mounted the sliding block which may be displaced radially and which is fast with the lower end of a threaded rod which extends along the slide and lever and which is in mesh, near the axis of oscillation of this lever, with a nut itself fast with a coaxial toothed pulley which is coupled, via a toothed belt extending right through the hollow shaft, to another driving toothed pulley located on the other side of the frame of the device and which may be driven in rotation.

14. The device of claim 13, wherein the driving toothed pulley is coupled to the shaft of a servo-motor of a device for servo-control by any magnitude such as the tension of the web.

15. The device of claim 12, wherein the sliding block is fast with a horizontal and transverse spindle on which the end of the connecting rod is articulated via roller bearings.

16. The device of claim 15, wherein the other end of the connecting rod is articulated on a crank pin itself articulated, about a pin, on a drum rotating about a horizontal and transverse pin, the crank pin bearing, at its free end, two cam rollers which roll respectively in two different transverse planes, inside a fixed cam and outside a fixed counter-cam.

17. The device of claim 1, wherein the means for maintaining the tension of the web on entering the machine comprise an aspirating roller rotating constantly at a peripheral speed greater than that of the web and, inside the aspirating roller, a suction box connected with to a source of vacuum, this suction box being in contact with a part of the inner surface of the roller of which the lateral surface is pierced with holes, the position of the suction box and its extension in the direction of rotation of the aspirating roller corresponding to the zone of contact of the web on the peripheral surface of the aspirating roller.

* * * * *